US005495903A

United States Patent [19]

Griffin et al.

[11] Patent Number: 5,495,903

[45] Date of Patent: Mar. 5, 1996

[54] PULSATION NOZZLE, FOR SELF-EXCITED OSCILLATION OF A DRILLING FLUID JET STREAM

[76] Inventors: William A. Griffin, Templeuisce, Templemichael, Glanmire, Co. Cork; Sextus M. De Almeida, 5 Glendower Court, Ballincollig Cork, both of Ireland

[21] Appl. No.: 211,686

[22] PCT Filed: Oct. 15, 1991

[86] PCT No.: PCT/GB91/01790

§ 371 Date: Sep. 8, 1994

§ 102(e) Date: Sep. 8, 1994

[87] PCT Pub. No.: WO93/08365

PCT Pub. Date: Apr. 29, 1993

[51] Int. Cl.[6] ..... E21B 7/18; E21B 7/24; B05B 1/08; F15B 21/12

[52] U.S. Cl. ..... 175/424; 175/56; 175/67; 239/589.1

[58] Field of Search ..... 175/56, 67, 424; 239/589.1, 101; 299/17, 14; 137/807, 814, 833

[56] References Cited

U.S. PATENT DOCUMENTS

| | | | |
|---|---|---|---|
| 3,532,174 | 10/1970 | Diamantides | 175/56 |
| 3,542,142 | 11/1970 | Hasiba et al. | 175/424 X |
| 3,610,347 | 10/1971 | Diamantides | 175/56 |
| 4,071,097 | 1/1978 | Fulop et al. | 175/56 |
| 4,389,071 | 6/1983 | Johnson, Jr. et al. | 175/67 X |

FOREIGN PATENT DOCUMENTS

| | | |
|---|---|---|
| 2054479U | 3/1990 | Canada . |
| 0333484A | 9/1989 | European Pat. Off. . |
| 0370709A | 5/1990 | European Pat. Off. . |
| 1195862 | 6/1970 | United Kingdom . |
| 1198328 | 7/1970 | United Kingdom . |
| 2104942 | 3/1983 | United Kingdom . |
| 91/08371 | 6/1991 | WIPO . |

OTHER PUBLICATIONS

8th Int'l Symposium of Jet Cutting Technology; J. F. Liao, D. S. Huang; "Nozzle device for the self-excited oscillation of a jet"; Sep. 1986; pp. 195–201.

V. E. Johnson, Jr. et al.; "Cavitating and Structured Jets for Mechanical Bits to Increase Drilling Rate–Part I: Theory and Concepts" (ASME Journal of Energy Resources Technology, vol. 106, Jun. 1984, pp. 282–288).

V. E. Johnson, Jr. et al.; "Cavitating and Structured Jets for Mechanical Bits to Increase Drilling Rate–Part II: Experimental Results" (ASME Journal of Energy Resources Technology, vol. 106, Jun. 1984, pp. 289–294).

*Primary Examiner*—Stephen J. Novosad
*Attorney, Agent, or Firm*—Locke Purnell Rain Harrell

[57] ABSTRACT

A pulsation nozzle is adapted for insertion in a drill bit such as a single body or tri-cone bit, for delivery of a pulsed jet of thixotropic drilling fluid during drilling operations. The nozzle defines an inlet orifice (31) communicating with an internal cavity (32) and an outlet orifice (33), the dimensions of which are chosen in such a way as to induce the cyclical propagation of disturbances in a shear boundary defined between fluid passing directly through the nozzle and fluid which is momentarily trapped in the cavity, thereby inducing a self-excited oscillating flow of said fluid within the nozzle, and a rapid pulsing flow emitting from the nozzle.

12 Claims, 4 Drawing Sheets

PULSATION NOZZLE, FOR SELF-EXCITED OSCILLATION OF A DRILLING FLUID JET STREAM

TECHNICAL FIELD

The present invention relates to a pulsation nozzle, for self-excited oscillation of a thixotropic fluid such as a drilling fluid jet stream, particularly in rotary single body or tri-cone rock drills used in drilling deep wells for oil and gas exploration.

BACKGROUND ART

The kerfing process of a mud jet in assisting the mechanical action of a drill bit is well understood. The drilling mud also lubricates and cools the bit, and is circulated so as to carry away cuttings and rock debris. Normally, drilling mud is directed through a series of conical or tapering nozzles contained in slots above the bit roller cones or defined in the sides of the bit, in a continuous stream.

It is also known that pulsed jets have significant kerfing advantages over continuous stream jets. By exerting alternating loads onto the rock formation pulsed jets may not only produce a high momentary "waterhammer" effect, but may also produce high tensile stress on the compression strength of the formation. This would give rise to the weakening of the formation through the reflection of stress waves, prior to any mechanical shearing, gouging, or scraping action of the drill bit, leading to faster removal of debris and faster penetration rates.

However, a downhole tool that produces a pulsed jet through mechanical interruption or mechanical excitation of the normal or steady flow of drilling fluid would cause large energy losses, as well as mechanical wear on the indispensable moving parts and seals. Oscillating valve arrangements to cause flow pulsing are described, for example, in European Patent Specification Nos. 0,333,484A and 0,370,709A. A nozzle is described in British Patent Specification No. 2,104,942A for restricting flow and inducing cavitation, i.e. the formation of bubbles in the fluid which implode on contact with the rock formation, which weakens and erodes the surface being drilled. However, in order to improve removal of rock debris, fluid is also directed at higher pressure through a non-cavitating nozzle to provide a cross flow. It will be appreciated that a single nozzle delivering a rapidly oscillating pulsed flow would achieve these effects more efficiently.

A self-excited, acoustically resonating nozzle causing the emitted jet to be structured with large discrete vortex rings is described by V. E. Johnson, Jr. et al (ASME Journal of Energy Resources Technology, Vol. 106, June 1984, p. 282–288). A nozzle with a reduced diameter "organ pipe" section for creating acoustically resonant standing waves inside the nozzle induces excitation and structuring of the jet outside the nozzle, which can also be accompanied by cavitation. However, this proposal does not suggest that self-excited oscillation of the jet may be induced inside the nozzle, so as to produce a rapidly pulsating jet as it emits from the nozzle. Furthermore, a problem associated with acoustically resonating nozzles is that the length of the nozzle is limited by the space available in the bit plenum for locating the nozzles. Nozzle extensions are also subject to breakage and failure down hole.

A nozzle for the self-excited oscillation of a Newtonian fluid such as water, producing a pulsed jet for brittle material cutting applications has been investigated by Z. F. Liao and D. S. Huang (Paper 19, 8th International Symposium on Jet Cutting Technology (1986) Durham, England). The nozzle comprises a simple axisymmetric cavity with an inlet and an outlet orifice of smaller diameter than the cavity diameter. Periodic pressure pulses are generated in the shear layer between the jet in the cavity and the surrounding fluid, and the jet oscillates as it emits from the nozzle to atmosphere. However, there is no teaching of a similar effect in a non-Newtonian or thixotropic fluid such as drilling mud, emitting from a nozzle to a high pressure fluid environment as opposed to ambient air.

DISCLOSURE OF INVENTION

It has now been found that a self-excited pulsed jet effect, similar to the type described by Liao and Huang, may be produced with high pressure drilling fluid in a nozzle defining an axisymmetric cavity. This effect is independent of a very significant pressure load, or "back pressure", at the bottom hole produced by the weight of drilling mud and cuttings in the annulus surrounding the drill string and the hydrostatic pressure of the drilling mud. Surprisingly, a self-excited pulsed jet may be produced with a rapid oscillation frequency which is modulated in an apparently regular, lower frequency pattern. This latter effect is advantageous in enhancing stress deflection and break-up of the rock formation.

The present invention therefore overcomes the drawbacks of prior art devices and provides a nozzle for self-excited oscillation of a mud jet stream, producing a pulsed flow which may be incorporated, for example, in existing nozzle slots in standard tri-cone drill bits without special adaptation, with the potential to greatly increase drilling rates.

According to the present invention, there is provided a pulsation nozzle for self-excited oscillation of a fluid which nozzle defines a cavity (3) having an axisymmetric inlet orifice (2) and outlet orifice (4), wherein the inlet orifice is adapted to restrict and accelerate incoming flow of drilling fluid, the diameter ($D_3$) of the outlet orifice is greater than the diameter ($D_1$) of the inlet orifice, the diameter of the cavity (D) is greater than the diameter ($D_3$) of the outlet orifice, characterised in that the axial length (L) of the cavity is chosen so as to induce the cyclical propagation of disturbances in a shear boundary defined between a thixotropic fluid passing directly through the nozzle and thixotropic fluid which is momentarily trapped in the cavity, thereby inducing a self-excited oscillating flow of said fluid within the nozzle, and a rapid pulsing flow emitting from the nozzle.

The inlet orifice preferably defines conical or inwardly-tapering side walls (33). Most preferably, the axial length of the inlet orifice is greater than the axial length (L) of the cavity. The outlet orifice preferably defines cylindrical side walls, but may also define conical or outwardly-tapering side walls. The cavity is preferably cylindrical. The intersection of the curved cylindrical wall and planar floor and roof surfaces of the cavity is preferably curved, that is, not defined by a right angle.

Advantageously, the intersection of the cavity floor and the outlet orifice side walls is defined by a sharp edge. The intersection between the outlet orifice side walls and the exterior is also preferably provided by a sharp edge. The sharp edge is preferably hardened, most preferably by a coating or insert of diamond or CBN.

The ratio $D_3$:$D_1$ is preferably 1.01 to 1.30, most preferably 1.10 to 1.23.

The nozzle may define two intercommunicating cavities divided by a partition wall defining an intermediate axisymmetric orifice, the diameter ($D_2$) of which is greater than or equal to the diameter ($D_1$) of the nozzle inlet orifice.

The length L of the cavity is preferably chosen such that: $L>D_3$, or $L<3D_1+3D_2$.

The invention also provides a drill tool or drill bit incorporating a nozzle for self-excited oscillation of drilling fluid as described herein.

Furthermore the invention provides a method of drilling a borehole using a drill tool incorporating a pulsation nozzle as described herein, wherein drilling fluid is supplied to the nozzle at a pressure of greater than about 120 p.s.i.

BRIEF DESCRIPTION OF DRAWINGS

FIG. 1 shows a pulsation nozzle in accordance with a first, and simplest embodiment of the invention. The nozzle comprises a cylindrical housing 1 defining an inlet orifice 2 of diameter $D_1$, communicating with a cavity 3, of cylindrical shape, diameter D and axial length L, in turn communicating with outlet orifice 4, of diameter $D_3$. The corners 5 of the cavity are preferably rounded with a radius of 2 mm, for example. The intersection between the cavity floor 6 and the outlet orifice side walls 7 is most preferably a sharp hard edge, and may be formed by an artificial diamond or cubic boron nitride (CBN) insert ring or edge coating. The intersection between the roof 8 of the cavity and the side walls 9 of the inlet orifice 2 may also be a sharp hard edge. As described below, these edge regions are vitally important in initiating propagation of vorticity disturbances when drilling fluid is flowing through the nozzle under pressure.

The preferred relationships of $D_1$, $D_3$, D and L are referred to above, but it is essential that $D_3$ is greater than $D_1$ and that D is significantly greater than $D_1$ or $D_3$. The length L of the cavity must be carefully chosen—if it is too short fluid will pass straight through the nozzle in a jet without the propagation of the desired flow disturbances between the interface of a high pressure fluid jet passing from orifice 2 to orifice 4 and fluid under lower pressure which remains for a longer period in the cavity. If L is too long, disturbances which are non-cyclic or irregular might be propagated, but this will not produce the rapid, cyclic self-excited oscillation of fluid in the cavity at the jet interface which is desired and which gives rise to a regular pulsating flow of fluid emitting from orifice 4. The net cavity length may be increased effectively by providing two adjacent cavities as described below with reference to FIG. 3. In an example, when $D_3$:$D_1$ is 1.10 to 1.23, given that $D_1$ is about 10 mm, L is preferably between 17 and 29 mm.

Figure 1:
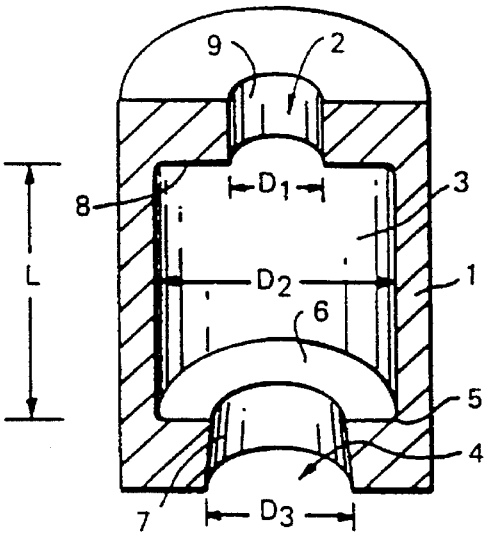
FIG. 1 shows a perspective view from above in longitudinal cross-section of a pulsation nozzle in accordance with a first embodiment of the invention.
Figure 2A:
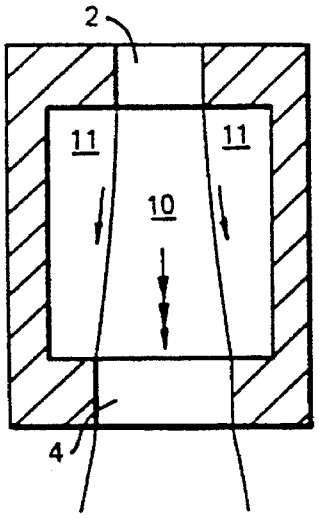
FIGS. 2*a* to 2*d* show schematically the theoretically assumed mode of propagation of a self-excited oscillating flow through the nozzle of FIG. 1.
Figure 2B:
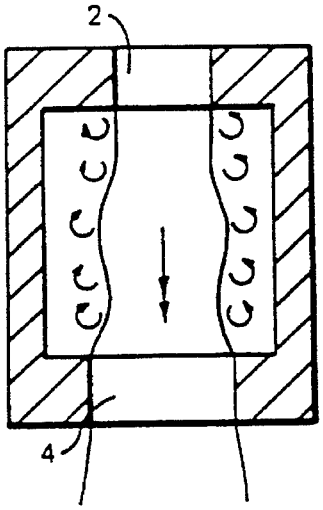
Figure 2C:
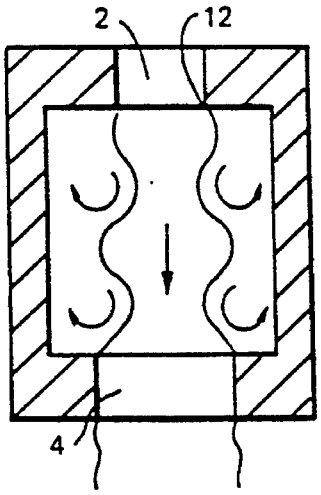

FIGS. 2*a* to 2*d* illustrate a theoretically assumed mode of propagation of disturbances in the flow of pressure fluid through the nozzle shown in FIG. 1. It will be appreciated that it is difficult to observe the actual mode of propagation in the laboratory as the oscillating frequency established is extremely rapid. Firstly, as shown in FIG. 2*a*, jet 10 of high pressure fluid is passed through orifice 2, which because of the restriction in flow and decrease in diameter, increases rapidly in velocity, as compared to fluid on entering the nozzle and to fluid 11 in the remainder of the cavity. Fluid 11, all the more so because of the relatively high density and viscosity of drilling muds generally, becomes subject to high shear forces at the boundary between it and jet 10. The shearing action causes vortex rings to form around the jet. These vortices are propagated initially at the edge of orifice 2 and move down the boundary in an orderly manner as shown in FIG. 2*b* until they impinge on the edge of orifice 4. By this stage expansion of the jet will cause the vortex rings to move away from the boundary and propagate or feed back upstream to the sensitive initial shear separation region 12 adjacent the edge of orifice 2 as shown in FIG. 2*c*. This induces vorticity fluctuations. The inherent instability of the shear separation at the boundary layer of the jet amplifies the small disturbances imposed on the initial shear separation region.

Figure 2D:
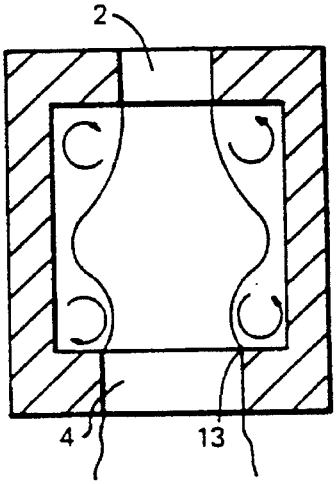

The amplified disturbance will then travel downwards to impinge the edge again, as shown in FIG. 2*d*. Thereupon the events are repeated and a loop consisting of the emanation (FIG. 2*b*), feedback (FIG. 2*c*), and amplification (FIG. 2*d*) is enclosed.

As a result a strong oscillation in the shear layer and the potential jet core is developed. A fluctuating pressure field may be set up within the cavity as a whole and the velocity of the jet emitting from the outlet orifice 4 varies periodically.

It should be appreciated that the oscillation comes without any external excitation and as such is described as "self-exciting". Thus, no moving parts or valve arrangements are required to bring about a pulsed flow.

A nozzle, as shown in FIG. 1, may be adapted to fit into the nozzle-holding slots of most rotary bit designs.

Figure 3:
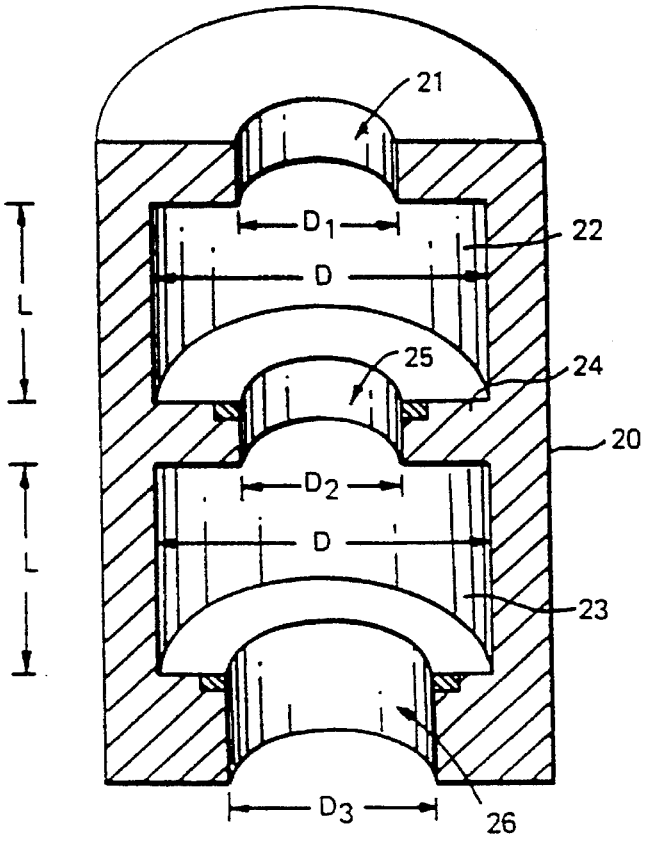
FIG. 3 shows a perspective view from above in longitudinal cross-section of a pulsation nozzle in accordance with a second embodiment of the invention.

FIG. 3 shows a second embodiment of the invention, wherein a nozzle 20 comprises an inlet orifice 21 of diameter $D_1$, a cavity which is partitioned into two cavities 22 and 23 of equal size (each of length L and diameter D) by a partition wall 24 defining an intermediate orifice 25 of diameter $D_2$, and having an outlet orifice 26 of diameter $D_3$. The length and diameter of cavities 22 and 23 does not have to be the same; the cavity 23 may be slightly larger in diameter, for example. This arrangement permits the propagation of two separate enclosed loops as described above in cavities 22 and 23, and results in a greater net velocity increase in the jet emitting from orifice 26 on account of the greater overall cavity length.

BEST MODE FOR CARRYING OUT THE INVENTION

Figure 4:
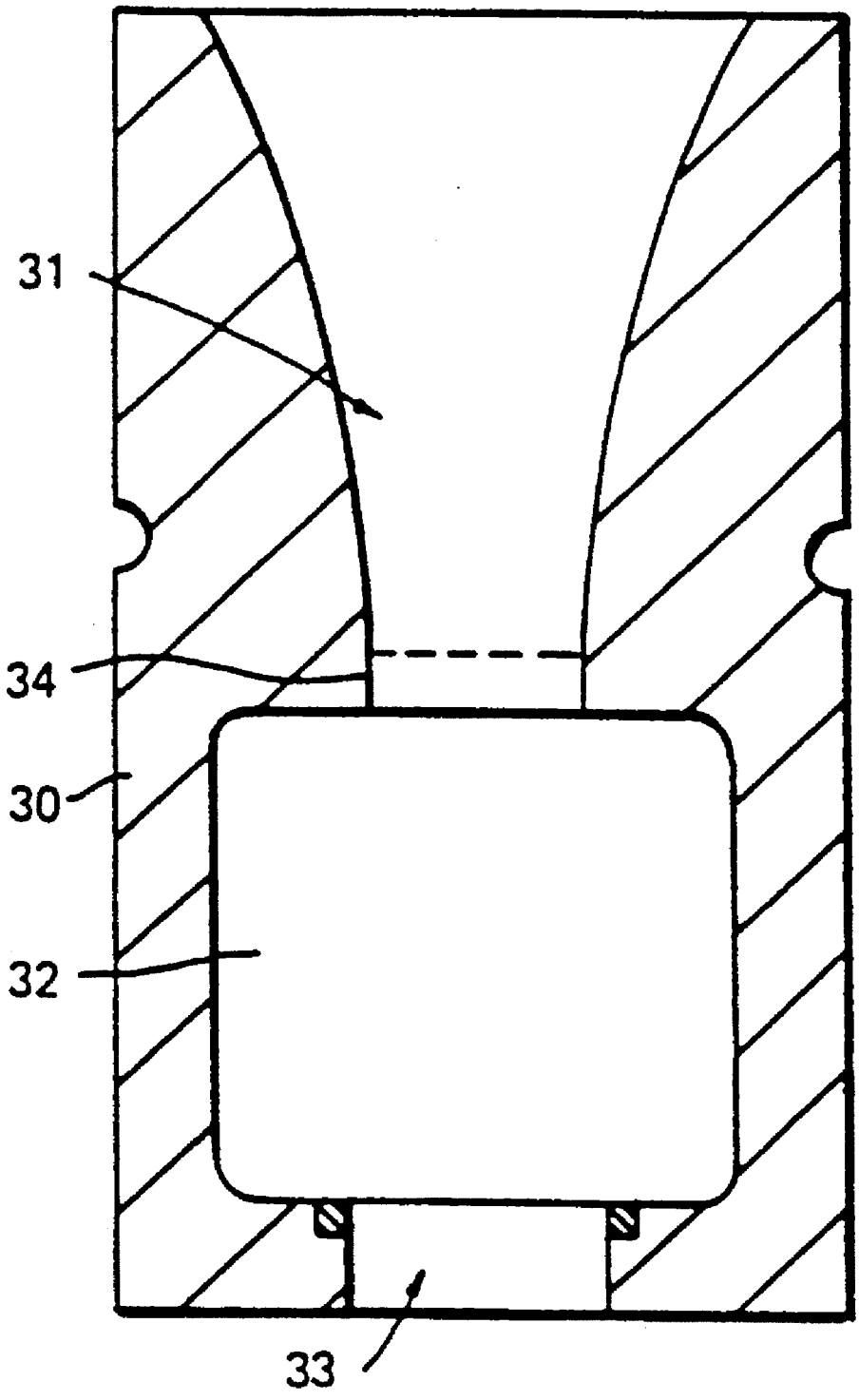
FIG. 4 shows in longitudinal cross-section a pulsation nozzle in accordance with a third embodiment of the invention.

FIG. 4 shows a favoured embodiment wherein nozzle 30 comprises a cylindrical cavity 32, an outlet orifice 33 having cylindrical walls, and an enlarged inlet orifice 31 having outwardly tapering trumpet-shaped walls. It should be noted that a short cylindrical surface is present at 34 after the tapering surface ends. This may be of the order of 3 mm when the tapering walls would be of the order of 19 mm, for example. The length of the cavity 32 in this example would be about 27 mm. Such a nozzle may be made from an alloy, consisting, for example, of 84% tungsten carbide and 16% cobalt by volume.

The trumpet-shaped inlet orifice 31 has the effect of funneling the drilling mud into the nozzle cavity and reduces fluid pressure losses as compared to the cylindrical inlet orifices described with reference to FIGS. 1 and 3. Surprisingly, the fluid is funneled more than expected and a "vena contracta" effect is produced, which is probably due to the fact that the drilling mud is thixotropic, i.e. its viscosity decreases with increasing velocity, and in this situation the incipient jet in the cavity is squeezed by the lower velocity/higher viscosity surrounding fluid. This phenomenon may also lead to greater shearing at the jet boundary in the cavity in this embodiment.

TEST RESULTS

A nozzle conforming to the following critical dimensions was tested using drilling mud supplied thereto at a line velocity of 57.5 m/s.

| | |
|---|---|
| Inlet orifice diameter | 13 mm. |
| Outlet orifice diameter | 14 mm. |
| Cavity length | 17 mm. |

Figure 5:
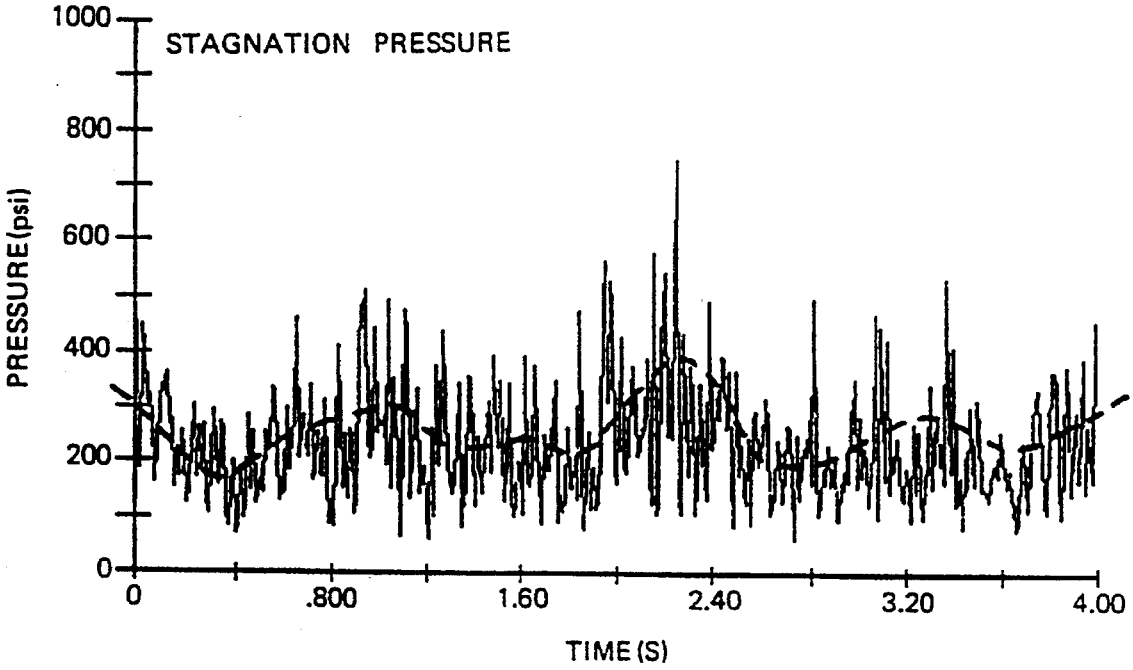
FIG. 5 is a graph of pressure versus time, plotting the nozzle or stagnation pressure during a test.

FIG. 5 demonstrates the very rapid oscillation of pressure within the nozzle during the test. The mean pressure variation with time also varies more or less regularly as shown by the dashed curve. This has been referred to above as a modulation of the oscillation frequency. However, both high frequency (e.g. greater than about 1 KHz) and low frequency (e.g greater than about 20 Hz) primary oscillations may be induced. The modulated frequency is typically in the order of 0.25–10 Hz.

Figure 6:
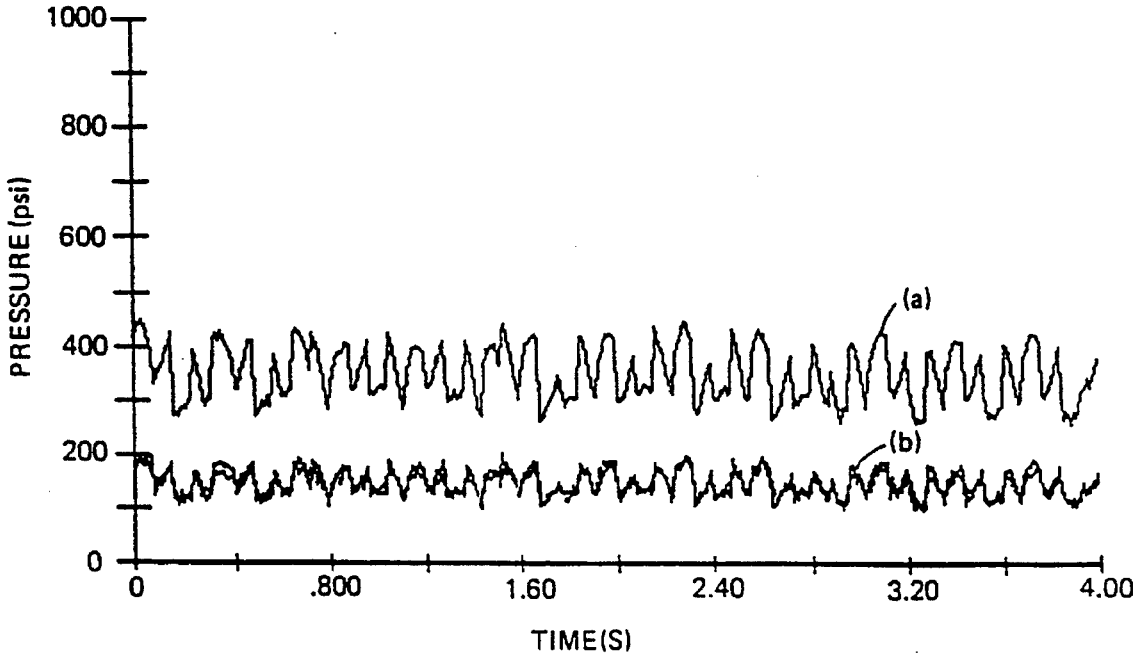
FIG. 6 is a graph of pressure versus time, plotting (a) line pressure, and (b) back pressure during the same test.

FIG. 6 demonstrates the corresponding variation in pressure as measured (a) in the fluid upstream of the nozzle (line pressure), and (b) in the fluid downstream of the nozzle (back pressure).

What is claim:

1. A pulsation nozzle for self-excited oscillation of a thixotropic fluid, comprising a cavity having a diameter (D) and an axial length (L), and which nozzle further defines an axisymmetric inlet orifice having a diameter ($D_1$) and an outlet orifice having a diameter ($D_3$) in fluid communication with said cavity, wherein the inlet orifice is adapted to restrict and accelerate an incoming flow of a thixotropic drilling fluid when the nozzle is placed in a drill tool, the diameter ($D_3$) of the outlet orifice being greater than the diameter ($D_1$) of the inlet orifice, the diameter of the cavity (D) being greater than the diameter ($D_3$) of the outlet orifice, wherein the axial length (L) of the cavity is chosen so as to induce the cyclical propagation of disturbances in a shear boundary defined between the thixotropic fluid passing directly through the nozzle and thixotropic fluid which is momentarily trapped in the cavity, thereby inducing a self-excited oscillating flow of said fluid within the nozzle, and a rapid pulsing flow emitting from the nozzle.

2. A nozzle as claimed in claim 1 wherein the inlet orifice defines inwardly-tapering side walls narrowing in the direction of the cavity.

3. A nozzle as claimed in claim 2 wherein the axial length of the inlet orifice is greater than the axial length (L) of the cavity.

4. A nozzle as claimed in claim 3 wherein the intersection of the cavity floor and the outlet orifice side walls is defined by a sharp edge.

5. A nozzle as claimed in claim 4 wherein the sharp edge is hardened.

6. A nozzle is claimed in claim 5 in which the sharp edge is hardened by a coating or insert of diamond or cubic boron nitride.

7. A nozzle as claimed in claim 2 wherein the outlet orifice defines cylindrical sidewalls.

8. A nozzle as claimed in claim 1 wherein the ratio $D_3$:$D_1$ is 1.01 to 1.30.

9. A nozzle as claimed in claim 8 wherein the ratio $D_3$:$D_1$ is 1.10 to 1.23.

10. A nozzle as claimed in claim 1 in which the axial length (L) of the cavity is chosen such that (L) is greater than ($D_3$).

11. A pulsation nozzle for self-excited oscillation of a fluid, comprising an axisymmetric inlet orifice having a diameter ($D_1$) and an outlet orifice having a diameter ($D_3$), a first cavity having a diameter (D) in fluid communication with said inlet orifice, a second cavity having a diameter (D) in fluid communication with said outlet orifice, said nozzle defining an intermediate partition wall dividing said first and second cavities, said intermediate partition wall defining an intermediate axisymmetric orifice having a diameter ($D_2$) providing for fluid communication between said first and second cavities, wherein said inlet orifice is adapted to restrict and accelerate an incoming flow of a thixotropic drilling fluid when the nozzle is placed in a drill tool, the diameter ($D_2$) of the intermediate axisymmetric orifice being greater than the diameter ($D_1$) of the inlet orifice, the diameter (D) of said first and second cavities being greater than the diameter ($D_3$) of the outlet orifice, and wherein the combined axial length (L) of said first and second cavities is chosen so as to induce the cyclical propagation of disturbances in a shear boundary defined between the thixotropic fluid passing directly through the nozzle and thixotropic fluid which is momentarily trapped in one or both cavities, thereby inducing a self-excited oscillating flow of said fluid within the nozzle, and a rapid pulsing flow emitting from the nozzle.

12. A nozzle as claimed in claim 11 wherein the combined axial length (L) of said first and second cavities is less than $3(D_1)+3(D_2)$.

* * * * *